United States Patent [19]

Hosie

[11] 4,441,631

[45] Apr. 10, 1984

[54] OPENER AND POURING SPOUT WITH HOLDER FOR FLEXIBLE WALL CONTAINERS

[76] Inventor: Alistair M. Hosie, 219 Superior St., Victoria, British Columbia, Canada, V8V 1T4

[21] Appl. No.: 361,424

[22] Filed: Mar. 24, 1982

[51] Int. Cl.[3] ..... B67B 7/26

[52] U.S. Cl. ..... 222/86; 222/89; 222/105; 222/478; 222/567

[58] Field of Search ..... 222/80, 81, 85, 86, 222/88, 89, 90, 105, 478, 566, 567, 83, 83.5

[56] References Cited

U.S. PATENT DOCUMENTS

| | | | |
|---|---|---|---|
| 1,785,599 | 12/1930 | Schmerler . | |
| 2,740,555 | 4/1956 | Howden . | |
| 3,255,923 | 6/1966 | Soto . | |
| 3,792,799 | 2/1974 | Henfrey | 222/90 |
| 3,809,290 | 5/1974 | Schmit | 222/90 |
| 4,179,042 | 12/1979 | Schuck . | |
| 4,247,020 | 1/1981 | Desjardins | 222/83.5 |

*Primary Examiner*—Joseph J. Rolla
*Assistant Examiner*—Charles C. Compton
*Attorney, Agent, or Firm*—Christensen, O'Connor, Johnson & Kindness

[57] ABSTRACT

A combined opener, pouring spout and installation device for flexible wall liquid container bags, including apparatus to perforate first one wall and then the opposite wall in the process of installing a pouring spout inner member and including a device serving as an outer member to retentively engage the inner member in a clamping arrangement that seals the bag around the pouring spout opening in its wall. Withdrawal of the carrier member leaves the first opening in the bag wall opposite the pouring spout available as a breathing spout.

10 Claims, 9 Drawing Figures

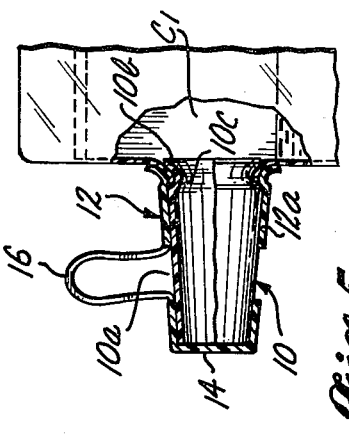
Fig. 5.
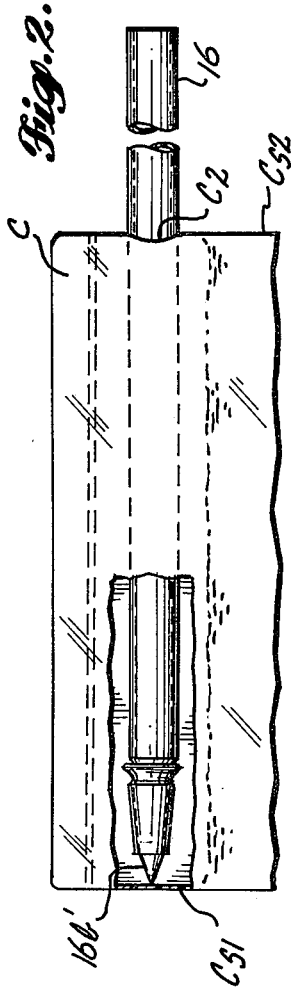
Fig. 2.
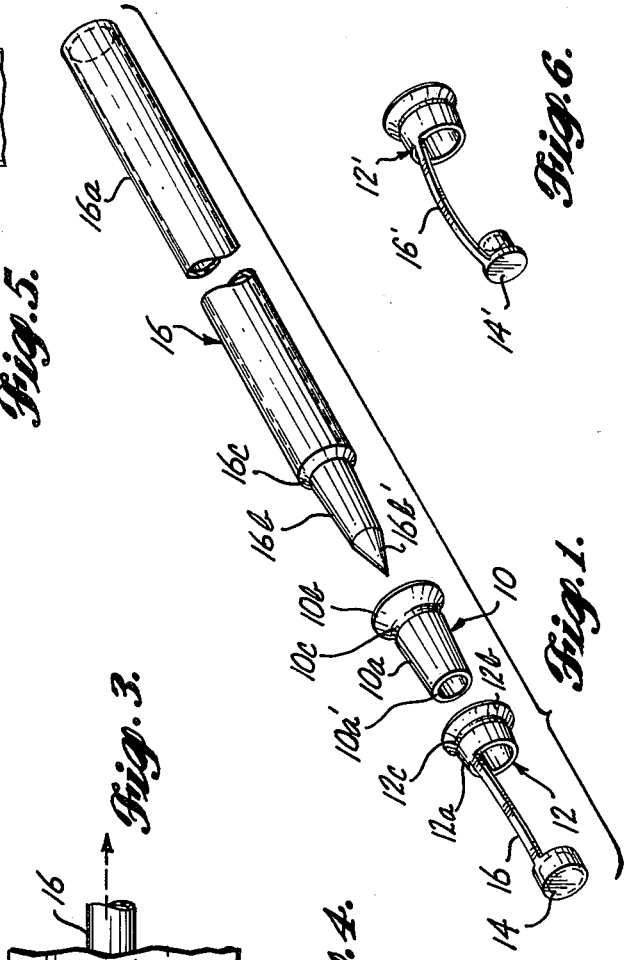
Fig. 1.
Fig. 6.
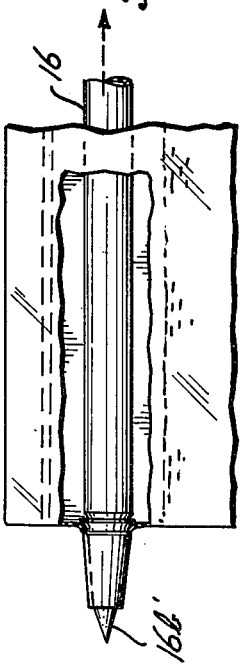
Fig. 3.
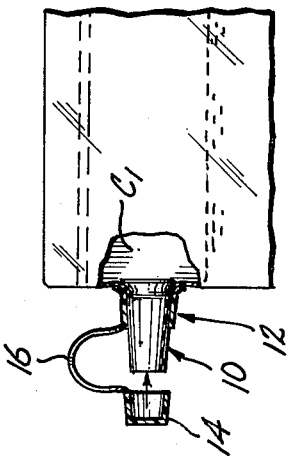
Fig. 4.

OPENER AND POURING SPOUT WITH HOLDER FOR FLEXIBLE WALL CONTAINERS

BACKGROUND OF THE INVENTION

This invention relates to low cost means for use with flexible wall closed containers, such as plastic milk bags and juice bags, or the like, to facilitate pouring liquids (or granular material, for example) from the container in a controlled manner and without spillage. More particularly, the invention concerns a kit assembly and holder means for such usage, including means for installing the same quickly and easily. The invention is herein illustratively described by reference to the presently preferred embodiments thereof; however, it will be recognized that certain modifications and changes therein wi th respect to details may be made without departing from the essential features involved.

The high cost and other problems associated with use of glass and metal containers in marketing milk, juices and other liquids, as well as some fine grain granular substances that can be poured, have pointed up the need for greater use of thin-wall disposable plastic container bags, and the like, in these applications. Thin-wall plastic bags for such purposes have the distinct advantage of extremely low cost and disposability without need for recycling. However, they have been awkward to handle in dispensing liquids in a controlled manner and without spillage. Concepts for devices relating to aspects of this problem have been advanced, but apparently have not been generally accepted nor successful. Examples of prior concepts include those disclosed in the following U.S. Pat. Nos. 1,785,599; 2,740,555; 3,255,923 and 4,179,042.

The present invention was conceived and developed as an improved opener, holder and pouring spout assembly for such containers. Convenience of installation and use and minimizing of cost permitting disposal as refuse with the empty container, or for reuse when desired, are objectives hereof. The invention provides a liquid-tight seal at the pouring spout juncture with the plastic bag container, and it also provides a breather or vent opening to maintain atmosph eric pressure within the container during pouring of its contents into a receiver. The invention also contemplates a novel means to maintain a flexible wall plastic bag or other container in manageable position wthin a holder jug, starting with the container full inserted into the jug and continuing until it is empty, employing a pouring spout member installed with the unopened container inserted into the jug in the additional role of a positional retainer for the bag within the jug.

These and other features, objects and advantages of the invention will become fully evident from the description that follows by reference to the accompanying drawings.

SUMMARY OF THE INVENTION

In accordance with this invention, a kit assembly is provided for establishing a pouring spout and breather vent for thin-wall plastic container bags, including an inner spout member held on a carrier and punched through first one wall and then partly through the opposite wall where its flange functions as a stop shoulder and clamp face. An outer member or clamp collar, preferably formed with a detent cooperable with a complemental detent on the inner member, has an opposing clamp shoulder. When the outer member is forced over the projecting inner member, the clamp elements grip the bag wall around the inner member to form a seal. In a second embodiment, a holder jug for the bag has a preformed opening serving as the outer member.

BRIEF DESCRIPTION OF THE DRAWINGS

FIG. 1 is a perspective view of the kit assembly with parts separated in mutual alignment.

FIG. 2 is a side elevation view of a plastic container (upper portion) illustrating the installation method for positioning the inner member of the pouring spout assembly.

FIG. 3 is a view similar to FIG. 2 with the inner member advanced into operative placement projecting through the second wall of the container after it has been passed forcibly through the first wall, as shown in FIG. 2.

FIG. 4 is an installed view of cooperable elements of the pouring spout with the closure cap associated with the outer member about to be placed over the pouring spout.

FIG. 5 is an enlarged view of the installation shown in FIG. 4 with the cap in place.

FIG. 6 is a perspective view of a molded outer member with a cap connected therewith by a tie and molded of unitary plastic material.

DETAILED DESCRIPTION REFERRING TO DRAWINGS

Figure 8:
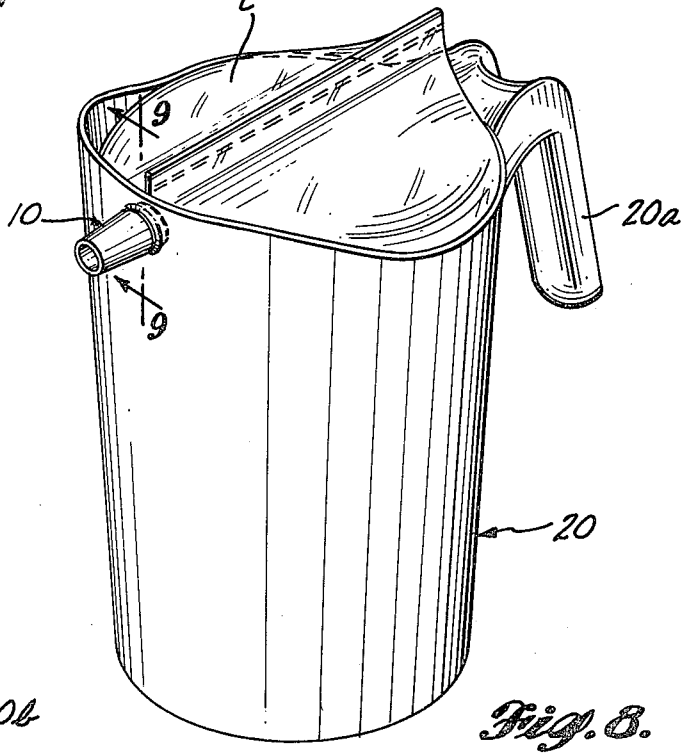
FIG. 8 is an isometric view of the installation completed, which is in process as shown in FIG. 7.

The kit assembly as depicted in FIGS. 1 to 6, inclusive, comprises an open end molded plastic inner member 10 with an elongated, gently tapered frusto-conical tubular body portion 10*a*, terminating at a first end in a discharge spout 10*a*'. At its opposite or base end, member 10 terminates in an annular flange 10*b*. In operating position, the forward face of flange 10*b* forms an abutment shoulder that bears outwardly against the inside face of the container wall surrounding the opening $C_1$ in container C. The inner member is advanced into operating position by forcing its tip to penetrate the bag wall at that location. In operating position (FIGS. 4 and 5), the portion 10*a* projects outwardly beyond the wall of the container through which it passes. It is held there and sealed at its flanged base to the container wall opening rim by the clamping action of an annular outer member 12, preferably formed of similar plastic material. Member 12 has a tubular frusto-conical portion 12*a* of an inside diameter range and form to tightly encircle the inner member body portion 10*a*. A clamp flange 12*b* presses the container wall material around the opening $C_1$ against flange 10*b* so as to form a liquid-tight seal.

While friction alone may serve for retention of the outer member 12 on inner member 10 so as to maintain the liquid-tight integrity of the joint, it is preferred to employ more positively secure holder means. This preferably takes the form of an annular exterior groove formation 10*c* in inner member 10 where flange 10*b* joins body portion 10*a*. Groove formation 10*c* is engageable by an annular interior rib formation 12*c* of outer member 12. These annular formations snap into retentive interengagement as the members approach final positional relationship during advancement of the outer member over the inner member, resilience of the material itself forcing a final increment of interengaging motion, hence forcing a firm and retentive clamping action of the opposing flanges against the container wall material between them.

A removable closure 14 friction fitted to spout 10*a*′ and secured by a flexible tie strap 16 may be molded of one piece with outer member 12, as shown.

In order to install the cappable sealed pouring spout provided by the inner member 10, the kit also includes an elongated carrier 16, preferably in the form of a hand-held, elongated plastic rod. The rod is made hollow over most of its elongated handle or base portion 16*a* so as to conserve plastic material from which it is molded. Its tip portion 16*b*, which receives the inner member 10, preferably terminates in a point 16*b*′at one end that projects beyond the tip 10*a*′of the inner member and in an annular abutment shoulder 16*c* at its opposite end that serves as a stop for the inner member carried by the rod. With the rod carrying the inner member 10, the rod is advanced, forcing the inner member 10, first through one side wall of the container, $C_{S2}$, near the container top, and in the process thereof, forming a breather vent opening for the container, and thereafter, through the opposite wall $C_{S1}$. Such advancement motion in which the container walls are perforated in successive order as a part of the installation procedure for the pouring spout assembly is indicated by the arrow in FIG. 2.

With the inner member 10 thus held in operative position by carrier 16, as shown in FIG. 3, projecting through the wall opening $C_1$, outer member 12 is then forced into interengagement with the inner member 10 (FIG. 4) as a clamp collar thereon. Thereupon, carrier 16 may be withdrawn (arrow in FIG. 3) ready for subsequent use on a fresh container and associated pouring spout assembly. The same members 10 and 12 may be used over and over, if desired, or they may be discarded when the container in which they are installed is emptied and discarded. Discarding is made feasible because of the very low cost at which this kit assembly may be produced, including the members 10 and 12.

Figure 7:
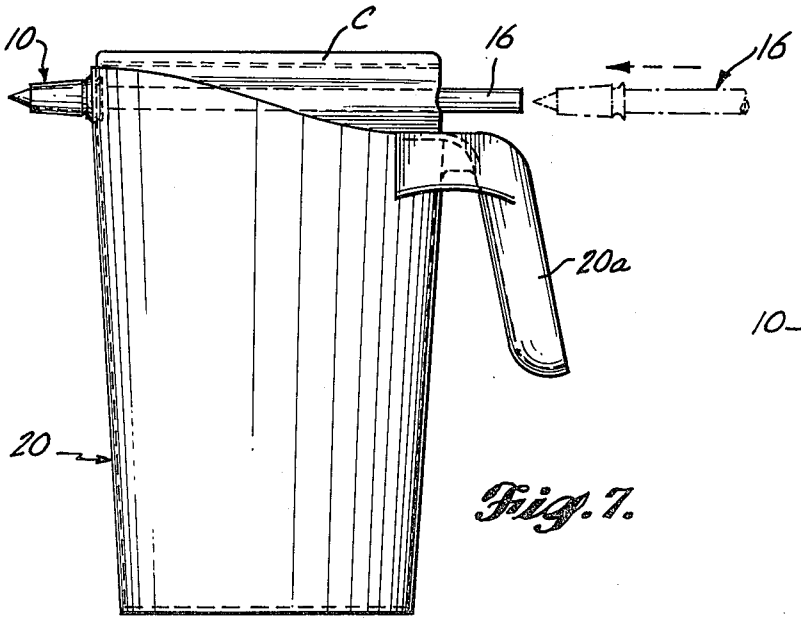
FIG. 7 is a side elevation view of the second embodiment of the invention in which a holder jug for a liquid container bag serves as the outer member of the pouring spout assembly, and in which the inner member of such assembly helps to hold the bag in position relative to the jug.
Figure 9:
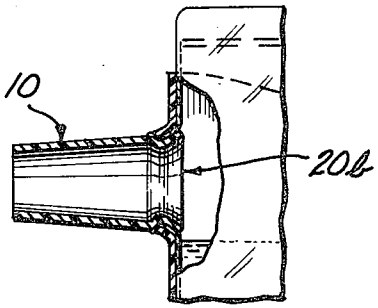
FIG. 9 is a transverse sectional view taken on line 9—9 in FIG. 8.

In the embodiment of FIGS. 7 through 9, inclusive, a holder jug 20 is employed to receive the flexible wall plastic container bag. It has a handle 20*a* on one side near its top and a preformed wall opening 20*b* opposite the handle and at a slightly higher position on the jug than the upper end of the handle 20*a*. Thus, when carrier 16 advances the inner member through first one wall and then the opposite wall of container bag C, it clears the handle and then continues through the jug wall opening 20*b* formed for the purpose. The annular rim material of the jug wall opening 20*b* has a degree of rigidity and such a form that it may serve as the outer member 12, analogizing to the previously disclosed embodiment. Thus, the rim of the opening 20*b* is formed as a clamp flange against which the bag wall material is pressed by engagement with the inner member flange 10*b*. Also, its inner rim portion functions as an inside detent rib formation that snaps into retentive engagement with the outside detent groove formation 10*c* of the inner member 10 in this embodiment. Thus, equivalent snap action detent engagement is also achieved with this arrangement. It will also be observed that the inner member 10 not only functions as a pouring spout for the jug held container bag C, but it also serves as a positioning holder to prevent slumping of the bag down into the jug, a tendency as contents of the jug are poured out.

It will further be noted in both cases, that is, in both embodiments, that the first hole $C_2$ made in the container becomes a breather vent that maintains pressure within the container equal to atmospheric pressure as contents of the container are reduced.

If the rim of spout 10*a*′ is sufficiently sharp and rigid, it may be unnecessary to have a pointed carrier tip 10*b*′ project beyond the element 10*a*′ in order to force the inner member through the bag walls and into position by perforating action. In other words, the leading perforating element could, in such instances, become the spout itself, 10*a*′, rather than a projecting pointed tip on the carrier.

These and other aspects and variations of the kit assembly representing this invention will be recognized by those skilled in the art from the foregoing description referring to the presently preferred embodiments.

The embodiments of the invention in which an exclusive property or privilege is claimed are defined as follows:

1. An installation kit assembly for an opener and pouring spout to be used with flexible, perforable wall liquid containers, and the like, said assembly including mutually interengageable members including an annular inner member having a first end insertable outwardly of the container through an opening punched for the purpose in a first side wall of said container so as to project in a snug fit outwardly through said opening with the inner member operably positioned, said inner member having an annular shoulder adapted to bear against the inside of said wall around said opening, and an outer member having an annular portion formed to closely encircle the projecting portion of the inner member and retentively interengage the same adjacent said shoulder, said outer member having an annular shoulder formed complementally to the inner member shoulder so as to clamp the container wall around said opening between said shoulders with the members interengaged, and a hand-held, elongated carrier having a tip portion adapted to hold the inner member thereon and advance the same into operable position through the wall of the container opposite said first wall, said elongated carrier being thereupon removable by withdrawal from said inner member.

2. The assembly defined in claim 1 wherein the members comprise tubular sleeves, at least one such member having slight endwise taper outwardly in relation to the container requiring wedging of the other member in relation thereto so as to effect interengagement therebetween and thereby provide retentive frictional contact between the members.

3. The assembly defined in claim 1 wherein the members are formed with respective mutually complemental detent elements, one of which snaps into interengagement with the other as the members interengage.

4. The assembly defined in any of claims 1 2 or 3 wherein the inner member projects outwardly from the container wall beyond the outer member interengaged therewith.

5. The assembly defined in either of claim 1 or 2 wherein the members are formed with respective mutually complemental detent elements, one of which snaps into interengagement with the other as the members interengage, and a holder jug for the container, said jug leaving an open top for receiving and removing containers in and from the jug, said holder jug having a side wall with an opening therein rimmed by a wall formation comprising said annular outer member.

6. The assembly defined in claim 3 wherein the detent elements comprise mating annular rib and mating annular groove formations in the respective members.

7. The assembly defined in claim 6 wherein the respective groove and rib formations comprise surfaces contiguous to the respective shoulders, whereby container wall material around the wall opening extending outwardly from the shoulders may also extend into and be clamped between the rib and groove formations.

8. The assembly defined in any of claims 1,2 or 3 wherein the inner member projects outwardly from the container wall beyond the outer member, and a closure cap removably mounted on the outer end of the inner member and secured to the outer member by an elongated flexible connection molded integrally with said cap and outer member of a synthetic plastic material.

9. The assembly defined in claim 1 wherein the elongated carrier comprises a rod-like member having a bag perforating point on its tip portion extremity and, back of said point, an abutment stop thereon abutted by the inner member during positional advancement of the inner member through the container walls.

10. In combination, a holder and pouring device to be used with flexible, perforable wall liquid containers, and the like, including mutually interengageable members including an annular inner member having a first end insertable outwardly of the container through an opening punched for the purpose in a first side wall of said container so as to project in a snug fit outwardly through said opening with the inner member operably positioned, said inner member having an annular shoulder adapted to bear against the inside of said wall around said opening, an outer member having an annular portion formed to closely encircle the projecting portion of the inner member and retentively interengage the same adjacent said shoulder, said outer member having an annular shoulder formed complementally to the inner member shoulder so as to clamp the container wall around said opening between said shoulders with the members interengaged, said inner member being movable into operable position by forcing it through the wall of the container opposite said first wall, and a holder jug for the container, said jug leaving an open top for receiving and removing containers in and from the jug, said holder jug having a side wall with an opening therein rimmed by a wall formation comprising said annular outer member.

* * * * *